United States Patent [19]

Sevastakis

[11] Patent Number: 4,471,830

[45] Date of Patent: Sep. 18, 1984

[54] CONTINUOUS CASTING

[76] Inventor: Gus Sevastakis, 5645 Angola Rd., Toledo, Ohio 43615

[21] Appl. No.: 90,049

[22] Filed: Oct. 31, 1979

Related U.S. Application Data

[63] Continuation-in-part of Ser. No. 974,317, Dec. 29, 1978.

[51] Int. Cl.[3] ..... B22D 11/00

[52] U.S. Cl. ..... 164/421; 164/443; 164/465

[58] Field of Search ..... 164/82, 89, 443, 444, 164/348

[56] References Cited

U.S. PATENT DOCUMENTS

| | | | |
|---|---|---|---|
| 2,169,893 | 8/1939 | Crampton et al. | 164/443 X |
| 4,211,270 | 7/1980 | Shinopoulos | 164/89 X |

FOREIGN PATENT DOCUMENTS

| | | | |
|---|---|---|---|
| 201250 | 6/1958 | Austria | 164/443 |
| 932119 | 8/1973 | Canada | 164/443 |

*Primary Examiner*—Kuang Y. Lin

*Attorney, Agent, or Firm*—William E. Mouzavires

[57] ABSTRACT

In the art of continuous vertical casting, an improved cooler assembly surrounds the forming die through which molten metal is poured for forming elongated metallic bar products which may be solid or hollow. The cooler assembly includes a cooling sleeve surrounding the die in continuous intimate contact; and a jacket surrounding the cooling sleeve and spaced therefrom to provide space for receiving a coolant. Along a substantial intermediate length of the cooling sleeve is formed a continuous helical or spiral groove for controlling the flow of coolant from the bottom to the top of the cooler assembly while increasing surface contact of the coolant with the cooling sleeve and the jacket itself. Coolant is introduced into and discharged from the cooler assembly at an oblique angle to initiate helical flow of the coolant about the sleeve and also avoid cold spots and consequently grain and strength imperfections in the bar product being cast. The upper and lower ends of the cooling sleeve in its inner regions adjacent the die are recessed to control the heating and cooling of the cooling sleeve itself to avoid warpage of the cooling sleeve which can harmfully unseat the die, to avoid rupture of the welds which fasten the cooling sleeve to the jacket, and to protect the inner edge of the cooling sleeve from damage during handling a set-up time.

18 Claims, 3 Drawing Figures

CONTINUOUS CASTING

RELATED PATENT APPLICATION

In some respects, the present application is related to my pending U.S. patent application Ser. No. 974,317, filed Dec. 29, 1978 and entitled "Cooling System For Continuous Casting Of Bar Products". The present application is therefore a continuation-in-part of my aforementioned pending application Ser. No. 974,317.

BACKGROUND OF INVENTION

Continuous vertical casting of metallic bar products takes place at temperatures in the region of 2,200° F. or more. It is therefore necessary to provide cooling apparatus for cooling the forming die and the products being formed. In commercial operations where the rate of production is always important, the cooling of the die in the product should take place at a rapid pace so as to maintain the high production rate. Moreover, it is important that the cooling be effective so as not only to produce sufficient cooling but also uniform cooling throughout the die and the product being cast to avoid weak spots in the grain structure of the die which can damage the same as well as to avoid weak spots in the grain structure of the products being cast to thereby provide improved uniform strength throughout the product being cast. In addition, the cooling effects the grain appearance in the product being cast, therefore the cooling should be uniform to avoid an irregular grain appearance in the product which is objectionable.

In addition to protecting the die and ensuring uniform strength and grain characteristics in the product being cast, the cooling system should also effectively cool parts of the cooler assembly itself to avoid premature breakdown of the cooler assembly requiring replacement and slowing down production.

OBJECTS OF THE INVENTION

It is an object of the present invention to provide an improved cooler assembly for a continuous vertical casting operation which assembly will effectively cool the forming die and the product to be cast as well as parts of the cooler itself without requiring reduction in the rate of production of the casting operation. Included herein is the provision of such a cooler assembly and method which will prolong the life of the forming die as well as the cooler assembly itself. Further included herein is the provision of such a cooler assembly and method which will help to produce bars of uniform strength and homogeneous grain structure and appearance.

Another object of the present invention is to provide an improved cooler assembly for use in a continuous vertical casting operation which will provide enhanced and uniform cooling to the forming die as well as parts of the cooler itself at a relatively high rate appropriately corresponding to the rate of production of the bars being cast.

Another object of the present invention is to provide such an improved cooler assembly which will avoid unseating of the forming die caused by uneven cooling.

SUMMARY OF INVENTION

In summary, a cooler assembly in accordance with the present invention, includes a cooling sleeve which surrounds and is in intimate surface contact with the forming die; the latter being firmly seated in the sleeve through mating tapered surfaces. The cooling sleeve is spaced from a surrounding jacket to define a space for receiving coolant at the bottom of the cooler through ports which extend at an oblique angle to the cooling jacket in the desired direction of flow of the coolant about the cooling sleeve. The coolant is discharged from the space at the upper end of the cooler assembly by parts which also extend at an oblique angle to the jacket corresponding to the direction the coolant is flowing. The outer surface of the cooling sleeve for a substantial intermediate length thereof, is formed with a continuous helical or spiral passage for conducting the coolant from the bottom of the cooler assembly in a predetermined helical or spiral continuous path upwardly along and about the outer surface of the coolant sleeve. The outer surface of the cooling sleeve is spaced from the cooling jacket to provide sufficient space in which to allow the coolant to flow for also cooling the cooling jacket as well as the cooling sleeve. In one preferred form, the opposite upper and lower ends of the cooling sleeve at its outer surface are recessed inwardly and are free of the spiral passages to provide increased space in those regions for facilitating the proper flow of coolant into and out of the cooler assembly.

In addition, the upper and lower ends of the cooling sleeve about the internal die receiving passage thereof in the region about the forming die, are recessed to reduce the heat conductivity of the sleeve in those regions to avoid warpage of the cooling sleeve that has been known to unseat the forming die. Furthermore, these recesses reduce the heat stress on the welds fixing the sleeve to its jacket which welds would otherwise not be subjected to sufficient cooling because of their locations relatively remote from the coolant.

The upper end of the forming die itself is provided with "angled-down" inlet ports for introducing molten metal from the crucible into the die. The orientation of these ports is such as to avoid clogging of these ports by the mud seal which typically is placed between the forming die and the crucible.

DRAWINGS

Other objects and advantages of the present invention will become apparent from the following more detailed description taken in conjunction with the attached drawings in which.

DETAILED DESCRIPTION

Figure 1:
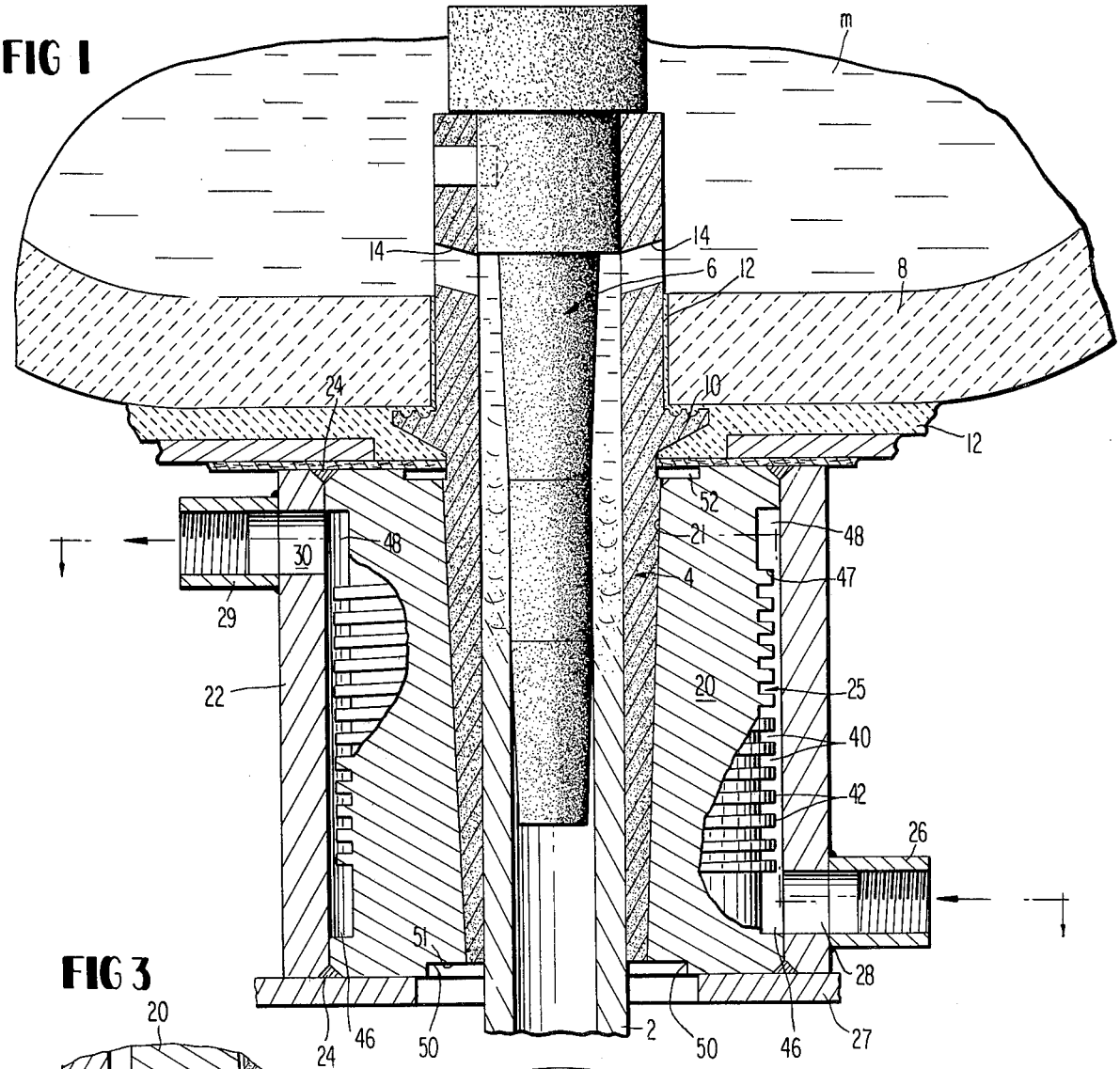
FIG. 1 is a cross-sectional elevational view of apparatus incorporating an embodiment of the present invention, for continuous vertical casting of bar products.

Referring now to the drawings in detail, there is shown for illustrative purposes only, apparatus constituting a preferred embodiment of the present invention, for use in the continuous vertical casting of solid or hollow elongated metal products, such as bronze or brass products; the drawings illustrating the production of a hollow elongated product designated 2. The product is formed by passage of molten metal through a die generally designated 4 which is made from graphite. In the specific embodiment shown, a mandrel 6 is employed within the die for the casting of the hollow bar product 2. The molten metal m is introduced into die 4 from a crucible, the die 4 being mounted through the bottom wall 8 of the crucible through means of annular flanges 10 projecting from an upper portion of die 4. The molten metal enters die 4 through ports 14 extending through the wall of the die in its upper region. The juncture between bottom wall 8 of the crucible and die 4 is typically sealed by refractory material 12. The parts described thus far are conventional and require no further explanation. However, in accordance with one of the features of the apparatus of the present invention, inlet ports 14 in the upper portion of die 4 through which the molten metal is introduced into the die, are angled downwardly at their positions above mud seal 12 at an angle which, in the preferred embodiment, is fifteen degrees (15°). This downward orientation of ports 14 is shown in FIG. 1 and is for the purpose of avoiding clogging of ports 14 by the mud seals 12 which heretofore has been known to occur. It is of course desirable to position ports 14 as low as possible to the bottom wall 8 of the crucible in order to utilize all of the molten metal in the crucible for casting, however, in the past, these ports have been known to occur because of their conventional 90° axial direction relative to the longitudinal axis of the die.

In order to cool die 4 and the product 2 cast therefrom, an improved cooler assembly is provided about die 4. The cooler assembly includes a cooling sleeve 20 made from a high conductive metal such as copper which is conventional and having a typical tapered through-passage 21 in which is firmly and intimately seated the die 4 which is tapered along its outer surface to match the taper of the cooling sleeve 20. Cooling sleeve 20 extends about and along die 4 from a point below floor 8 of the crucible to the lower end portion of die 4.

About cooling sleeve 20 extends a cylindrical jacket 22 made from a suitable material such as steel. Jacket 22 is coextensive in length with cooling sleeve 20 and these parts are welded together by annular welds 24 around their upper and lower end portions. The cooler assembly rests on a support plate 27. Jacket 22 is spaced from the outer surface of cooling sleeve 20 to define a space or chamber generally designated 25 for receiving a suitable coolant such as water which is introduced into the space from an inlet port 28 formed through the lower end portion of the jacket in registry with an inlet pipe 26. Coolant is discharged from the space 25 through an outlet port 30 formed through the upper end portion of the jacket 22 in registry with an outlet pipe 29.

In accordance with the present invention, the exterior surface of cooling sleeve 20 is provided with means forming a continuous helical or spiral flow path which starts from a lower end portion of the sleeve adjacent inlet port 28, preferably just above the latter and terminates in an upper end portion of the sleeve adjacent the outlet port 30, preferably just below the later. In the preferred embodiment shown, this flow channel is formed by a helical or spiral groove 40 in the outer surface of cooling sleeve 20; the groove 40 providing a continuous helical or spiral ridge 42 projecting radially outwardly from the cooling sleeve 20.

The outer surface of cooling sleeve 20 below the start of flow channel 40 and ridges 42 and above the termination of flow channel 40 and ridges 42 are not formed with any ridges or flow channels but are rather recessed to provide enlarged annular chambers 46 and 48 in registry with inlet and outlet ports 28 and 30 respectively. Annular chamber 46 ensures proper flow of sufficient coolant into the cooler assembly and further ensures that the coolant will flow into the helical path 40 as desired. It is preferred that the depth of channel 40 or ridges 42 be approximately one-quarter of an inch ($\frac{1}{4}$") or greater. Furthermore, it is important that there be sufficient space between the outer surface 47 of ridge 42 and the inner surface of jacket 22 to ensure the circulation of sufficient coolant as well as to ensure that the coolant will contact the outer surfaces 47 of ridge 42 and the surrounding surface portions of jacket 22.

During operation, coolant such as water entering inlet port 28 will be received in lower chamber 46 from where it will be gradually circulated about and upwardly along the outer surface of cooling sleeve 20 through helical channel 40 during which time the coolant contacts all surfaces of the ridge 42 as well as the inner surface of jacket 22. Thus, helical channel 40 and ridge 42 not only provide increased surface contact with cooling sleeve 20 but equally important, they control the flow path of the coolant so that rather than the coolant establishing a diagonal flow path from inlet port 28 to outlet port 30 diagonally across the surface of cooling sleeve 20, the coolant flows annularly along a helical path and gradually upwardly about cooling sleeve 20 to ensure a high degree of contact with cooling sleeve 20 as well as jacket 22.

It should also be noted that helical ridge 42 limits the outward expansion of cooling sleeve 20 due to heat because the outer surface portions 47 of ridge 42 in contact with the coolant are cooled to a greater degree than the inner surfaces thereof. Thus, the outer surface portions 47 have the effect of annular retaining rings inhibiting outward expansion of the inner portions of cooling sleeve 20 which are at a greater temperature. It is for this further purpose that the inner surface of jacket 22 must be spaced from the outer surface portions 47 of the ridge 42 to provide space for coolant to pass in contact with outer surface portions 47. In addition, the coolant will also cool the inner surface of jacket 22 which is important in order to prolong the life of the jacket 22 itself.

Figure 2:
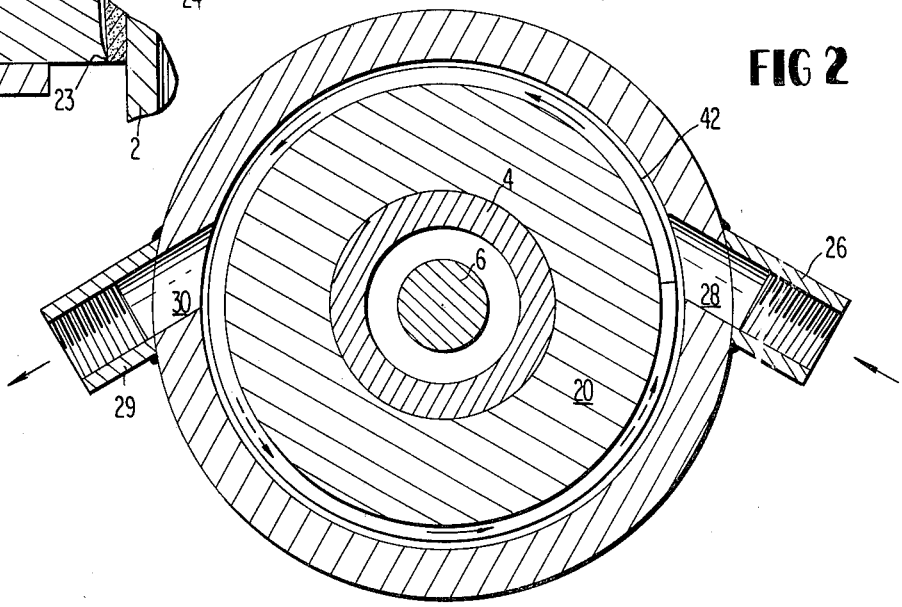
FIG. 2 is a cross-sectional view taken generally along lines 2—2 of FIG. 1.

In order to ensure that the coolant liquid does not accumulate in lower chamber 46 and upper chamber 48 adjacent inlet and outlet ports 28 and 30 that could cause harmful collection of deposits and inhibit movement of the coolant along the helical path 40, inlet and outlet ports are provided at an angular orientation in conformity with the direction of travel of the coolant about the helical flow path 40 as illustrated by the arrows in FIG. 2. In one preferred embodiment, these ports are provided at an angle of thirty degrees (30°) to a diametrical plane intersecting the flow axis of the ports. This angular orientation of inlet and outlet ports 28 and 30 will properly direct the coolant into and out of helical channel 40. The angular orientation of the inlet and outlet ports is also significant in avoiding cold spots which can appear as grain blemishes in the surface of the product 2 to be cast which have been known to occur when the coolant is fed directly into the cooler assembly against the outer surface of the cooling sleeve along a diametrical line. Cold spots in the product 2 not only become visible grain imperfections marring the appearance of the product but furthermore, they do not permit the achievement of homogeneous grain structure in the product and thus can result in weak spots.

Figure 3:
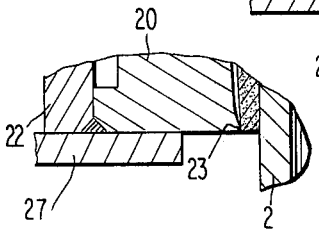
FIG. 3 is a fragmental cross-sectional view of a lower end portion of the cooling sleeve illustrating certain deformation which has occurred in conventional structures in the past.

In past conventional cooler assemblies of the prior art, die 2 has been known to become unseated from its proper intimate and continuous surface contact with cooling sleeve 20. This has been caused by inward heat expansion of the lower end of cooling sleeve 20 in the area immediately extending about die 2 forming an annular lip 23 in that area as shown in FIG. 3. The reason for this inward expansion is because that particular area of the cooling sleeve 20 is, relatively speaking, remote from the coolant and thus not subjected to the same degree of cooling as the remainder of the cooling sleeve 20. Once the die 2 becomes unseated, it will frustrate the cooling of the die and result not only in an inferior product 2 and slower production but also it can result in breakage of the die at its ends requiring replacement and stoppage production which becomes costly. In addition, the cooling sleeve must also be repaired to remove the lip.

In accordance with the present invention, the aforenoted problem is uniquely solved by providing a recess designated 50 in the lower end portion of the cooling sleeve in the region immediately extending about the lower end portion of die 2; and by dimensioning the length of die 2 so that its lower end terminates flush with the base surface 51 of the recess as shown in FIG. 1. It is preferred that the recess 50 have an annular configuration. Moreover, it has been found that the outside diameter of recess 50 should be approximately an inch greater than the outside diameter of die 4 at its lower end portion. In addition, for reasons to be explained below, the depth of recess 50 should be greater than the depth of weld 24 between cooling sleeve 20 and jacket 22. Preferably the depth of the recess is made to equal one-half the depth of the lower end portion of the sleeve 20 which lies below sleeve recess 46. For example, a recess with a depth of approximately one-quarter of an inch ($\frac{1}{4}''$) has been found to provide satisfactory results in coolers where the depth of the lower end portion of the sleeve 20 below its recess 46 is one-half of an inch ($\frac{1}{2}''$).

As noted above, the upper and lower outside surfaces of cooling sleeve 20 are continuously welded to the inside surface of the jacket 22 by means of welds 24 which extend annularly continuously and also provide a seal for the coolant chamber. With past cooler assemblies of the prior art, these welds 24 have been known to occasionally rupture because of excessive heat applied thereto, it being understood that the location of welds 24 relatively speaking, is remote from the coolant which passes through the cooler assembly. It will thus be seen that recess 50 at the lower end of cooling sleeve 20 as described above, also has the effect of reducing the heat applied to the adjacent weld 24 to prolong the life of the weld and, in turn, the entire cooler assembly. For this reason, the upper end of the cooling sleeve 20 about its inside surface which surrounds die 4 is also provided with an annular recess 52 so as to lessen the heat which will be transmitted to the adjacent upper weld 24 to prolong its life. Recess 52 will also have the effect of lessening damage to the inside upper annular edge of the cooling sleeve due to excessive heat. Undesired lip formation due to deformation at that edge will also be avoided. Recess 52 will also remove the internal edge of the cooling sleeve from accidental contact during handling and set-up time.

In addition to the stated objects, the present invention allows an economical welded cooler construction to be utilized while providing increased performance. Also, the present invention is admirably suited to quick changes in die sizes for producing different bar sizes. Of course, the ultimate advantage achieved by the present invention is increased production and production of high quality bars without increasing the cost.

Although the present invention is particularly suited to vertical continuous casting operations, it may also be applied to horizontal continuous casting operations.

What is claimed is:

1. For use in a continuous vertical casting operation, a cooler assembly comprising a cooling sleeve having a longitudinal through passage adapted to receive a forming die in close intimate surface contact with the die, a jacket surrounding and spaced from the cooling sleeve to define a space for receiving a coolant, said cooling sleeve having an outer surface including means including a helical ridge forming a continuous helical flow path extending along a substantial intermediate length of the sleeve for conducting coolant fluid from one end portion of the sleeve to another end portion of the sleeve, said ridge projecting radially outwardly from the outer surface of the cooling sleeve and terminating in an outer surface sufficiently spaced from the jacket to allow coolant to contact the outer surface of the ridge as well as surrounding portions of the jacket, and inlet and outlet ports extending through the jacket at opposite end portions thereof and communicating with the space between the jacket and the sleeve for introducing and discharging coolant.

2. The cooler assembly defined in claim 1 wherein the cooling sleeve has a lower end including wall portions defining a lower annular recess adapted to surround the lower end of an associated die to be received in the cooling sleeve, said annular recess being vacant to reduce the transmission of heat through the lower end of the cooling sleeve.

3. The cooler assembly defined in claim 2 wherein the cooling sleeve has an upper end opposite the lower end thereof, said cooling sleeve being welded at its upper and lower ends to the jacket, and wherein the upper end of the cooling sleeve in the region about the through passage includes walls defining an upper annular recess adapted to surround the upper end of an associated die to be received in the cooling sleeve, said upper annular recess being vacant to reduce the transmission of heat through the upper end of the cooling sleeve.

4. The cooler assembly defined in claim 1 wherein the cooling sleeve has lower and upper ends, and said helical flow path begins and ends above and below the lower and upper ends respectively of the cooling sleeve leaving enlarged annular recesses in the outer surface of the cooling sleeve on opposite ends of the helical flow path adjacent said inlet and outlet ports for facilitating the flow of coolant into and out of the cooler assembly.

5. The cooler assembly defined in claim 2 wherein the cooling sleeve has an upper end, and said helical flow path begins and ends above and below the lower and upper ends respectively of the cooling sleeve leaving enlarged annular recesses in the outer surface of the cooling sleeve on opposite ends of the helical flow path adjacent said inlet and outlet ports for facilitating the flow of coolant into and out of the cooler assembly.

6. The cooler assembly defined in claim 4 wherein said cooling jacket has upper and lower end portions and said inlet port is located at the lower end portion of the cooling jacket and the outlet port is located at the upper end portion of the cooling jacket, said inlet and outlet ports respectively communicatong with said enlarged annular recesses in the outer surface of the cooling sleeve.

7. The cooler assembly defined in claim 5 wherein said cooling jacket has upper and lower end portions and said inlet port is located at the lower end portion of the cooling jacket and the outlet port is located at the upper end portion of the cooling jacket.

8. The cooler assembly defined in claim 1 wherein said inlet and outlet ports extend at oblique angles relative to a line tangent to the outer surface of the cooling sleeve, the direction of the oblique angles corresponding to the direction of helical advancement of the helical flow path about the cooling sleeve.

9. The cooler assembly defined in claim 7 wherein said inlet and outlet ports extend at oblique angles relative to a line tangent to the outer surface of the cooling sleeve, the direction of the oblique angles corresponding to the direction of helical advancement of the helical flow path about the cooling sleeve.

10. In a cooler and die assembly for use in a continuous vertical casting operation including a cooler assembly having a cooling sleeve including upper and lower ends, a jacket surrounding the cooling sleeve, means for introducing a coolant in a space between the cooling sleeve and the jacket, and a forming die seated within the cooling sleeve; the improvement comprising a recess formed in the lower end of the cooling sleeve in the region immediately surrounding the forming die, said recess having an upper surface portion and wherein the forming die at its lower end terminates substantially flush with the upper surface portion of the recess, said recess being vacant to reduce the transmission of heat through the lower end of the cooling sleeve.

11. The assembly defined in claim 10 wherein said cooling sleeve has another vacant recess formed in its upper end in the region immediately surrounding the die.

12. The assembly defined in claim 11 wherein the cooling sleeve is welded to the jacket at the upper and lower ends thereof.

13. The assembly defined in claim 12 wherein the sleeve has a longitudinal axis and wherein the depths of said recesses measured in the direction of said axis are at least equal to the depths of welds measured in the direction of said axis fixing the cooling sleeve to the jacket at opposite ends thereof.

14. The assembly defined in claim 10 wherein said recess has an outside diameter approximately one inch greater than the outside diameter of the die measured at the lower end of the sleeve.

15. For use in a cooler assembly for cooling dies in a continuous casting operation, a cooling sleeve having a heat-conductive body including opposite ends and a tapered through passage extending between the ends for receiving a forming die, said body having a pair of annular recesses respectively in its opposite ends about said passage and communicating with said passage for reducing transmission of heat to said body at the opposite ends adjacent the passage, and wherein said body has an outer peripheral surface containing a continuous helical ridge starting adjacent one end and terminating adjacent the opposite end of the body and defining a continuous helical flow path for coolant about the outer surface of the body between the opposite ends thereof.

16. For use in a continuous vertical casting operation, a cooler assembly comprising a cooling sleeve having a longitudinal through passage adapted to receive a forming die in close intimate surface contact with the die, a jacket surrounding and spaced from the cooling sleeve to define a space for receiving a coolant, said cooling sleeve having an outer surface including means including a helical ridge forming a continuous helical flow path extending along a substantial intermediate length of the sleeve for conducting coolant fluid from one end portion of the sleeve to another end portion of the sleeve, said ridge projecting radially outwardly from the outer surface of the cooling sleeve and terminating in an outer surface sufficiently spaced from the jacket to allow coolant to contact the outer surface of the ridge as well as surrounding portions of the jacket, and inlet and outlet ports extending through the jacket at opposite end portions thereof and communicating with the space between the jacket and the sleeve for introducing and discharging coolant, said cooling sleeve has a lower end including wall portions defining a lower annular recess adapted to surround the lower end of an associated die to be received in the cooling sleeve, said annular recess being vacant to reduce the transmission of heat through the lower end of the cooling sleeve, said cooling sleeve having an upper end opposite the lower end thereof, said cooling sleeve being fixed at its upper and lower ends to the jacket by welds, the upper end of the cooling sleeve in the region about the through passage including walls defining an upper annular recess adapted to surround the upper end of an associated die to be received in the cooling sleeve, said upper annular recess being vacant to reduce the transmission of heat through the upper end of the cooling sleeve, and wherein said helical flow path begins and ends above and below the lower and upper ends respectively of the cooling sleeve leaving enlarged annular recesses in the outer surface of the cooling sleeve on opposite ends of the helical flow path adjacent said inlet and outlet ports for facilitating the flow of coolant into and out of the cooler assembly.

17. The cooler assembly defined in claim 16 wherein the sleeve has a longitudinal axis and wherein the depths of said upper and lower annular recesses measured in the direction of said axis are at least equal to the depths of the welds measured in the direction of said axis.

18. The assembly defined in claim 17 wherein said helical ridge projects radially outwardly from the outer surface of the cooling sleeve a distance of at least one-quarter of an inch.

* * * * *